United States Patent [19]

McHugh

[11] Patent Number: 4,606,482

[45] Date of Patent: Aug. 19, 1986

[54] NON-SLIP GARMENT HANGER

[76] Inventor: Dolores B. McHugh, 210 Wesley Rd., Ocean City, N.J. 08226

[21] Appl. No.: 791,835

[22] Filed: Oct. 28, 1985

[51] Int. Cl.[4] ..... A41D 27/22

[52] U.S. Cl. ..... 223/88; 223/92; 223/DIG. 4; 24/599

[58] Field of Search ..... 211/119, 118; 223/85, 223/88, DIG. 4, 92, 96, 91; 24/599, 598, 698

[56] References Cited

U.S. PATENT DOCUMENTS

| | | | |
|---|---|---|---|
| 1,010,183 | 11/1911 | Schmidt | 223/91 |
| 1,116,612 | 11/1914 | Neis | 223/88 X |
| 2,373,000 | 4/1945 | Young | 223/88 |
| 2,380,143 | 7/1945 | Better | 223/91 |
| 2,614,736 | 10/1952 | Sarti | 223/92 |
| 2,643,036 | 1/1953 | Schiffman | 223/88 |
| 2,877,939 | 3/1959 | Dolnick | 223/88 |
| 3,343,733 | 9/1967 | Schmednecht | 223/95 |
| 3,348,745 | 10/1967 | Basile et al. | 223/92 X |
| 3,425,604 | 2/1969 | Mauldin | 223/88 |
| 3,496,982 | 2/1970 | St. Pierre | 24/698 X |

FOREIGN PATENT DOCUMENTS

| | | | |
|---|---|---|---|
| 1019312 | 1/1953 | France | 223/88 |
| 1068860 | 7/1954 | France | 223/91 |
| 1102475 | 10/1955 | France | 223/88 |
| 1252208 | 12/1960 | France | 223/88 |
| 84453 | 1/1965 | France | 223/88 |
| 305680 | 3/1955 | Switzerland | 223/88 |
| 739195 | 10/1955 | United Kingdom | 223/88 |

*Primary Examiner*—Werner H. Schroeder
*Assistant Examiner*—Andrew M. Falik
*Attorney, Agent, or Firm*—Caesar, Rivise, Bernstein & Cohen, Ltd.

[57] ABSTRACT

A garment hanger is provided with a hook and a hanging section covered by a pre-formed sleeve of non-slip, protective material. One end of the hanging section is unconnected, so that the sleeve of material can be slipped over the unconnected end to cover the rods of the hanging section, which can be triangular in shape. The unconnected end is terminated with a second hook or other releasable type of connector so that it can be attached to the remainder of the hanger after the sleeve has been installed. Garments may then be placed on the hanger.

4 Claims, 6 Drawing Figures

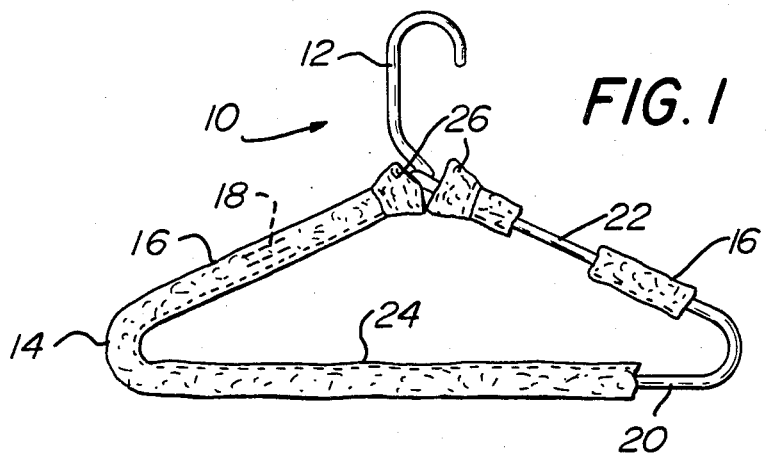
FIG. 1
FIG. 2
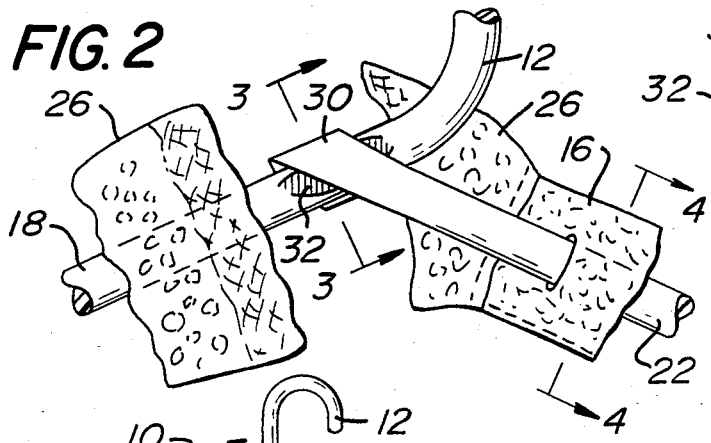
FIG. 3
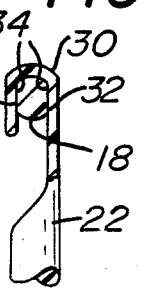
FIG. 4
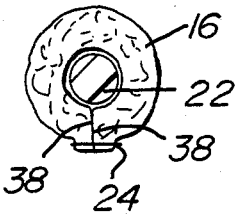
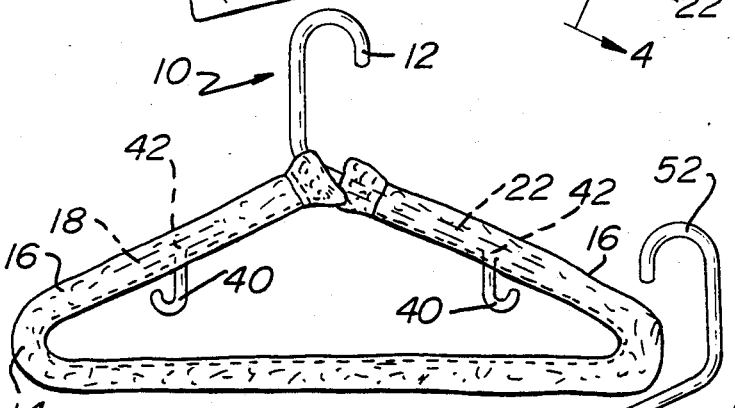
FIG. 5
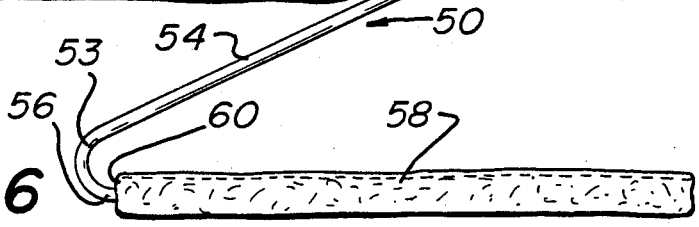
FIG. 6

NON-SLIP GARMENT HANGER

BACKGROUND OF THE INVENTION

This invention relates generally to garment hangers and more particularly to padded hangers which incorporate a pre-formed sleeve of non-slip, soft material.

Hangers have been disclosed in the patent literature and are commercially available which include covering portions of the hanger to provide strength and to prevent misforming of the hanger when garments are hung thereon, for example in U.S. Pat. No. 4,160,516 by Rice.

Rice, teaches the application of materials to wire hangers to increase the surfaces of the frame of the hanger and to strengthen the hanger. The material attached to the hanger is made of hard plastic or like material. A longitudinal opening in the material enables it to be placed upon the wires of the hanger frame, and bar attachements connect the material together to provide further strengthening.

A clothing hanger guard is disclosed by Hill in U.S. Pat. No. 4,040,545. The guard comprises a soft plastic sleeve, with one end closed and the other end open. The open end is slipped over the open end of the hanging hook of a wire hanger to strengthen the hook.

Other methods include the gluing of non-slip material to the frame of the hanger or the sewing of soft material onto the hanger after the hanger has been manufactured.

The sewing of soft material coverings onto hangers is tedious and expensive and does not allow for easy removal of the covering or replacement of the covering when the hanger is in use.

Existing devices do not provide for a simple inexpensive means for manufacturing a covered hanger which incorporates a pre-formed and pre-sewn sleeve of material for preventing slippage, clinging, snagging or tearing, mis-forming and creasing of garments, and which enables efficient drip drying of garments.

OBJECTS OF THE INVENTION

Accordingly, it is the general object of the invention to provide a garment hanger with a non-slip covering which overcomes the disadvantages of the prior art.

It is another object of the invention to provide a garment hanger including a pre-formed elongated sleeve of padding or protective material and which hanger can be readily assembled by either the manufacturer or the consumer or user.

It is a further object of this invention to provide a garment hanger which is arranged to be readily opened to enable a pre-formed sleeve of material to be readily placed thereon to protect garments to be suspended therefrom.

It is yet a further object of this invention to provide a garment hanger which is releasably covered by a non-slip material, which is washable and which prevents the clinging, snagging, and creasing of clothing.

SUMMARY OF THE INVENTION

The invention relates to a garment hanger which comprises a hook section and a hanging section, one end of which is unattached as manufactured. A sleeve of pre-manufactured longitudinally closed material may be slipped over the unattached end so that it covers the entire hanging section of the hanger. A means for attaching the unattached end is also included so that after the sleeve has been placed on the hanger, the unattached end can be attached to the junction of hanging section and the bottom of the hook to complete the structure of the hanger and allow for the hanging of clothes.

DESCRIPTION OF THE DRAWINGS

Other objects and many of the attendant advantages of this invention will be readily appreciated when the same become better understood by reference to the following detailed description when considered in connection with the accompanying drawings wherein:

FIG. 1 is a vertical view of one exemplary hanger constructed in accordance with this invention;

FIG. 2 is an enlarged view of a portion of the hanger shown in FIG. 1;

FIG. 3 is a sectional view taken along line 3—3 of FIG. 2;

FIG. 4 is a sectional view taken along line 4—4 of FIG. 2;

FIG. 5 is a vertical view of another embodiment of a hanger constructed in accordance with this invention; and FIG. 6 is a vertical view of yet another embodiment of a hanger constructed in accordance with the present invention.

DETAILED DESCRIPTION OF THE PREFERRED EMBODIMENT

Referring now in greater detail to the various figures of the drawing wherein like reference characters refer to like parts, there is shown in FIG. 1 a garment hanger 10 constructed in accordance with one embodiment of this invention. The hanger 10 is formed as an elongated, integral unit and basically comprises hook section 12, a hanging section 14, and sleeve of material 16 deposed over the body section.

The hanging section 14 is of generally triangular shape including two inclined rod portions 18 and 22 and integrally attached horizontal portion 20. Referring now to FIG. 2, the rod portion 18 is connected to the bottom of hook 12 while the rod 22 portion is terminated by hook 30. With hook 30 disconnected, a continuous sleeve 16, to be described later, can be slipped over the hook 30 to cover the entire hanging section 14. The hook 30 is arranged to be later connected to a portion of rod 18 (as will be described later), to ready the hanger for the hanging of garments therefrom.

This structure greatly simplifies and makes inexpensive the production of covered hangers since sleeve 16 can be pre-formed and pre-manufactured and slipped onto the hanger after production of the hanger. It removes the need for hand sewing sleeves or material to the hanging section after hanger production and allows for easy removal and reapplication of the sleeves for washing and other purposes.

The sleeve 16 is made of a non-slip material and it prevents clinging, snagging, creasing and misforming of garments. It may be made colorful and attractive. It is a continuous sleeve of material which has been applied to and cover rod portions 18, 20 and 22. The sleeve is shown in broken segments in FIG. 1 to illustrate that it is covering the rod portions comprising hanging section 14.

Sleeve 16 is made of a web of soft fabric material, such as a batting material, which has been rolled to form a tube and sewn together longitudinally along sewing line 24. The sleeve 16 can be fabricated of a fluffy material, and decorative frills 26 can be sewn onto the ends of sleeve 16 for further attractiveness.

An enlarged view of the junction of the bottom of hook 12 and the apex of triangular hanging section 14 is shown in FIG. 2. As seen in that figure, the hook 30 is located at the end of rod portion 22. The hook 30 is arranged to engage the end of rod portion 18 which is adjacent to the bottom of hook 12 to affect the connection therebetween. To that end, the end portion of rod portion 18 closest to hook 12 includes flattened areas 32. The flattened areas are arranged to engage and abut flattened inner surfaces of hook 30. The flattened inner surfaces of hook 30 are clearly shown in the sectional view taken along 3—3 of FIG. 2 and are identified by the reference numeral 34. Thus, when he hook 30 is connected to rod portion 18 adjacent to the base of the hook 12 the hanger is completed and is ready for garments to be placed thereon without the hook 30 tending to move or slide along the hanger rod portion 18.

When the hanger 10 is manufactured, the rod portion 22 is not connected to rod portion 18. Therefore a pre-manufactured longitudinally closed sleeve 16 may be slipped over hook 30 at the end of the hanging section and slid therealong to cover rods portions 22, 20 and 18 thereof. After the sleeve has been so placed the hook 30 is then connected to rod portion 18. The frills 26 can then be pushed towards and cover the junction of the bottom of hook 12 and the apex of hanging section 14 to conceal the connection.

On exemplary sleeve 34 for covering the hanger is shown in FIG. 4. As can be seen, the sleeve 16 is initially formed from a longitudinally extending strip of material. The longitudinal marginal edges 38 of the strip are brought into engagement and sewn together as shown by sewing along line 24 to form a continuous longitudinally closed sleeve or tube of material. The frills 26 may then be sewn to each end of sleeve 16. As described above sleeve 16 may then be slipped over the hanger.

Thus it can be seen that sleeve 16 can be mass produced by machine sewing and easily be applied to cover rod portions 18, 20 and 22 after such production. Moreover the sleeve can be formed as an integral tubular member, such as by molding, of any suitable material such as soft plastic or plastic foam.

FIG. 5 shows an alternative embodiment of garment hanger 10 wherein a pair of hooks 40 have been added, one to rod portion 18 and another to rod portion 22 to enable the hanging of skirts therefrom. To that end the hooks allow for skirts straps to be inserted thereon. In such a construction, slits 42 are provided in sleeve 16 to allow the hooks 30 to protrude therethrough.

A pants hanger using the sleeve material is shown in FIG. 6. As can be seen, the pants hanger 50 comprises a hook section 52, a hanging section 53 having a hanger rod portion 54, a pants rod portion 56, and a longitudinally closed sleeve 58. One end of the rod portion 54 is connected to the bottom of the hook section 52 while the other end of rod portion 54 is connected to pants rod portion 56. The end 60 of the sleeve 58 is open while end 62 of the sleeve 58 is closed. The sleeve 58 like the previously described sleeve 16, may be pre-formed. The sleeve 58 can then be slid over the pants rod portion 56 to cover it. Pants can then be hung on sleeve 58.

A suitable material for the sleeves 16 and 58 is polyester batting. The material is soft and fluffy, is washable and smooth, and will not allow clothes to slip. Further, it will not snag knit or loosely woven material. Clothes can be drip dried on the hangers. They will maintain their shape during the drying process since the sleeve is smooth. Finally, since the sleeves are smooth the clothing will maintain its shape and will not show bumps or marks or creases even after long periods of hanging.

Although the sleeves 16 or 58 may be mass produced by pre-manufacture of the sleeves, as described above, it may be desired in special cases, to hand sew the sleeves for high quality applications, such as exclusive boutiques or fur salons.

As mentioned previously, another suitable material for the pre-formed sleeves could be molded soft plastic or plastic foam.

The sleeve of material can be colorful and attractive, and pleasing to the eye of the consumer. The covered hanger is not only useful and appealing to consumers for a hanging of garments in their homes, but it is also of considerable value in many commercial areas where clothes must be hung and attractively displayed. This invention should be of particular value for the transportation of clothing, wherein the vibration motion of vehicles tend to cause the clothing to slip from the hangers. Thus traveling salesmen who hang clothing in their cars, and large wholesale distributors of clothing in trucks, should find the invention useful.

Manufacturers of clothing would find the invention of particular value in supplying an attractive, form protecting display of their garments to buyers. Retail outlets, boutiques and department stores would also find the invention useful for displaying their wares to customers. Finally, furriers who must hang and display heavy garments with very smooth and satin-like inner linings would find this invention valuable in preventing the slippage of the garments from the hangers, in providing an attractive display of their garments, and in maintaining the shape of the garments.

Without further elaboration the foregoing will so fully illustrate the invention that others may, by applying current or future knowledge, readily adapt the same for use under various conditions of service.

What is claimed is,

1. A covered garment hanger in the form of an elongated unitary member comprising a hook section and a hanging section having first and second inclined rod portions, said hanging section also including a horizontal rod portion whereby said inclined rod positions and said horizontal rod portion are integrally attached and upon which garments may be hung, said first inclined rod portion being connected to the said hook section, said second inclined rod portion of said hanging section comprising releasable securable means for connecting said second inclined rod portion of said hanging section to the said end of said first inclined rod portion which is adjacent to said hook section, and a longitudinally extending continuous sleeve of material arranged to be removably supported onto all three of said rod portions, said releasable securable means comprising hook means, said hook means comprising a generally U-shaped free end of said hanging section, said hook means having flattened areas and wherein said first inclined portion of said hanging section has flattened areas which abut said hook means flattened areas when said hook means engage the end of said first inclined rod portion, whereby said continuous sleeve upon opening said releasable securing means can be slipped onto all three of said rod portions.

2. The garment hanger of claim 1 wherein said member is formed as an integral unit of a plastic material.

3. The garment hanger of claim 1 wherein said sleeve comprises a non-slip, washable material.

4. The garment hanger of claim 1 wherein said hook section and said hanging section are each tubular.

* * * * *